US008066550B2

(12) United States Patent
Higuchi et al.

(10) Patent No.: US 8,066,550 B2
(45) Date of Patent: Nov. 29, 2011

(54) WAFER POLISHING METHOD AND APPARATUS

(75) Inventors: Daichi Higuchi, Ota-Ku (JP); Kazuma Tanaka, Ota-Ku (JP)

(73) Assignee: Disco Corporation, Tokyo (JP)

( * ) Notice: Subject to any disclaimer, the term of this patent is extended or adjusted under 35 U.S.C. 154(b) by 581 days.

(21) Appl. No.: 12/337,145

(22) Filed: Dec. 17, 2008

(65) Prior Publication Data

US 2009/0176444 A1 Jul. 9, 2009

(30) Foreign Application Priority Data

Jan. 8, 2008 (JP) ..... 2008-001495

(51) Int. Cl.
*B24B 1/00* (2006.01)

(52) U.S. Cl. ..... 451/44; 451/56; 451/285; 451/443

(58) Field of Classification Search ..... 451/41, 451/44, 46, 280–290, 443
See application file for complete search history.

(56) References Cited

U.S. PATENT DOCUMENTS 5,476,413 A * 12/1995 Hasegawa et al. ..... 451/168
5,727,990 A * 3/1998 Hasegawa et al. ..... 451/44
6,511,362 B1 * 1/2003 Akaike et al. ..... 451/5
2001/0034194 A1 * 10/2001 Hakomori ..... 451/44
2002/0182985 A1 * 12/2002 Shiino et al. ..... 451/44

FOREIGN PATENT DOCUMENTS

JP A 2003-53662 2/2003

* cited by examiner

*Primary Examiner* — Maurina Rachuba
(74) *Attorney, Agent, or Firm* — Greer, Burns & Crain, Ltd.

(57) ABSTRACT

A wafer polishing method, in which the outer circumferential edge of a polishing member is first cut by a cutting tool fixed to a table base, thereby forming the polishing member into a completely round shape and also positioning the polishing member in a Y direction at a Y-directional reference position of the table base. Thereafter, a polishing unit is once lifted in the condition where the table base remains still at the reference position. Thereafter, the table base is horizontally moved toward a column in the Y direction to thereby position the polishing member in the Y direction so that only a peripheral portion of the wafer is polished by the polishing member. At this time, the horizontal travel of the table base is preliminarily obtained from the Y-directional positional relation between the cutting tool and the wafer held on a chuck table and from the width of the peripheral portion to be polished. Finally, the polishing unit is lowered to make the lower surface of the polishing member into pressure contact with the peripheral portion of the wafer, thus polishing only the peripheral portion.

6 Claims, 5 Drawing Sheets

WAFER POLISHING METHOD AND APPARATUS

BACKGROUND OF THE INVENTION

1. Field of the Invention

The present invention relates to a method and apparatus for polishing a wafer such as a semiconductor wafer, and more particularly to a technique for polishing only an outer circumferential area as a limited area of the wafer.

2. Description of the Related Art

In a semiconductor device fabrication process including the steps of forming many devices on the front side of a wafer formed of a semiconductor such as silicon and dividing the wafer to obtain the individual devices, the back side of the wafer is ground to reduce the thickness of the wafer. Such a reduction in thickness of the wafer is made in response to a desired reduction in thickness of a device package. For example, the thickness of the wafer is reduced from about 700 μm to about 200 μm. However, in response to a recent remarkable reduction in thickness of a device package, there is a case that the thickness of the wafer is reduced to 50 μm or 30 μm.

In general, the back side of a wafer is ground by a method including the steps of rotating a grinding tool such as an abrasive member and bringing the rotating grinding tool into pressure contact with the back side of the wafer. However, the ground surface of the wafer on the back side thereof after grinding has a strain layer having a thickness of about 1 μm due to minute flaws by the grinding. The strain layer causes a reduction in die strength of the wafer, and it is therefore necessary to remove the strain layer, thereby maintaining the strength of the wafer. Known as means for removing the strain layer is a technique of polishing the ground surface of the wafer by using a disk-shaped polishing member containing abrasive grains (see Japanese Patent Laid-Open No. 2003-53662, for example).

The above publication describes that the whole of the back side of the wafer is polished. As described in this publication, the whole of the back side of the wafer can be polished by bringing the polishing member having a size capable of covering the ground surface of the wafer into pressure contact with the wafer being rotated as relatively moving the polishing member parallel to the wafer. Accordingly, no accurate control is required for this parallel movement of the polishing member.

In the field of wafer polishing, there is a case of polishing only an annular outer circumferential polishing area set on the back side of a wafer with a predetermined width from the outer circumferential edge of the wafer. Such polishing can be performed by relatively moving the polishing member from the outer circumferential edge of the wafer being rotated toward the center of the wafer by the predetermined width with high accuracy. However, such accurate movement of the polishing member requires accurate measurement of correlative positions of the polishing member and the wafer and control of the movement of the polishing member according to measured values, causing hard and complicated work. Further, unless the polishing member is formed into a completely round shape about a rotation axis, the outer circumferential polishing area having the predetermined width cannot be polished in spite of accurate parallel movement of the polishing member. The formation of such a completely round shape from the polishing member is also complicated and a simple method is therefore desired.

SUMMARY OF THE INVENTION

It is therefore an object of the present invention to provide a wafer polishing method and apparatus which can polish only a peripheral portion of a wafer accurately and easily.

In accordance with an aspect of the present invention, there is provided a wafer polishing method for polishing an annular outer circumferential polishing area set on one surface of a disk-shaped wafer with a predetermined width from the outer circumferential edge of the wafer by using a polishing apparatus including holding means having a holding surface for rotatably holding the wafer; working means having a disk-shaped polishing member opposed to the holding surface and rotatably supporting the polishing member so that the polishing member is rotatable about a rotation axis substantially perpendicular to the holding surface; first feeding means for relatively moving the working means to the holding means in a first direction substantially parallel to the holding surface; second feeding means for relatively moving the working means to the holding means in a second direction substantially perpendicular to the holding surface; and completely round polishing member forming means for forming the outer circumferential edge of the polishing member into a completely round shape about the rotation axis; the wafer polishing method including a completely round polishing member forming step of forming the outer circumferential edge of the polishing member into a completely round shape about the rotation axis by using the completely round polishing member forming means; a working means positioning step of relatively moving the working means parallel to the holding means in the first direction by using the first feeding means after the completely round polishing member forming step according to a distance in the first direction between the outer circumferential edge of the wafer held by the holding means and the completely round polishing member forming means, thereby positioning the working means in the first direction so that only the outer circumferential polishing area can be polished by the polishing member; and a polishing step of moving the working means in the second direction toward the holding means by using the second feeding means after the working means positioning step, thereby bringing the polishing member into pressure contact with the outer circumferential polishing area of the wafer to polish only the outer circumferential polishing area.

In this description, the first direction is a direction substantially parallel to the holding surface of the holding means, and the second direction is a direction substantially perpendicular to the holding surface of the holding means. The movement of the working means relative to the holding means in the first direction is the movement substantially parallel to the holding surface, and the movement of the working means relative to the holding means in the second direction is the movement substantially perpendicular to the holding surface.

At the time the completely round polishing member forming step is ended, the outer circumferential edge of the polishing member is formed into a completely round shape. Simultaneously, a reference position of the working means relative to the wafer held by the holding means in the first direction (the direction substantially parallel to the holding surface) is set in actually starting the polishing of the wafer. This reference position depends on the position of the completely round polishing member forming means. In the working means positioning step, the working means is relatively moved from the reference position toward the wafer in the first direction until the polishing member reaches a polishing position where it can polish only the outer circumferential polishing area of the wafer. This polishing position is determined according to the distance in the first direction between the outer circumferential edge of the wafer held by the holding means and the completely round polishing member forming means. The position of the outer circumferential edge of the wafer in the first direction can be obtained from the correlation between the rotation center of the holding surface of the holding means concentrically holding the wafer and the radius of the wafer. After ending the working means positioning step, the working means is moved toward the holding means in the second direction to bring the polishing member into pressure contact with the wafer. In the working means positioning step, the position of the working means in the first direction has been set so that only the outer circumferential polishing area of the wafer is polished by the polishing member. Accordingly, by moving the working means in the second direction to bring the polishing member into pressure contact with the wafer, only the outer circumferential polishing area can be polished by the polishing member.

According to the polishing method of the present invention, the distance in the first direction between the outer circumferential edge of the wafer held by the holding means and the completely round polishing member forming means is preliminarily determined and the outer circumferential edge of the polishing member is formed into a completely round shape by the completely round polishing member forming means. Thereafter, the working means positioning step and the polishing step are performed to thereby polish only the outer circumferential polishing area of the wafer. Accordingly, only the outer circumferential polishing area of the wafer can be polished accurately and easily.

In accordance with another aspect of the present invention, there is provided a wafer polishing apparatus for polishing an annular outer circumferential polishing area set on one surface of a disk-shaped wafer with a predetermined width from the outer circumferential edge of the wafer, the wafer polishing apparatus including holding means having a holding surface for rotatably holding the wafer; working means having a disk-shaped polishing member opposed to the holding surface and rotatably supporting the polishing member so that the polishing member is rotatable about a rotation axis substantially perpendicular to the holding surface; first feeding means for relatively moving the working means to the holding means in a first direction substantially parallel to the holding surface; second feeding means for relatively moving the working means to the holding means in a second direction substantially perpendicular to the holding surface; completely round polishing member forming means for forming the outer circumferential edge of the polishing member into a completely round shape about the rotation axis; and storing means for storing a distance in the first direction between the outer circumferential edge of the wafer held by the holding means and the completely round polishing member forming means.

Preferably, in the polishing method and the polishing apparatus according to the present invention, the completely round polishing member forming means is provided between the holding means and the working means in the first direction, and is movable together with the holding means. Furthermore, in forming the outer circumferential edge of the polishing member into a completely round shape about the rotation axis of the polishing member (in the completely round polishing member forming step of the polishing method), the polishing member being rotated is brought into contact with the completely round polishing member forming means. Further, the width of the outer circumferential polishing area of the wafer is arbitrary. However, particularly in the case that the width of the outer circumferential polishing area is as relatively small as 2 mm or less, the present invention is more effective.

According to the present invention, the distance in the first direction between the outer circumferential edge of the wafer held by the holding means and the completely round polishing member forming means is preliminarily determined. After the outer circumferential edge of the polishing member is formed into a completely round shape by the completely round polishing member forming means, the working means is relatively moved in the first direction according to the above distance, thereby positioning the polishing member in the first direction so that only the outer circumferential polishing area can be polished by the polishing member. Accordingly, only the outer circumferential polishing area of the wafer can be polished accurately and easily.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
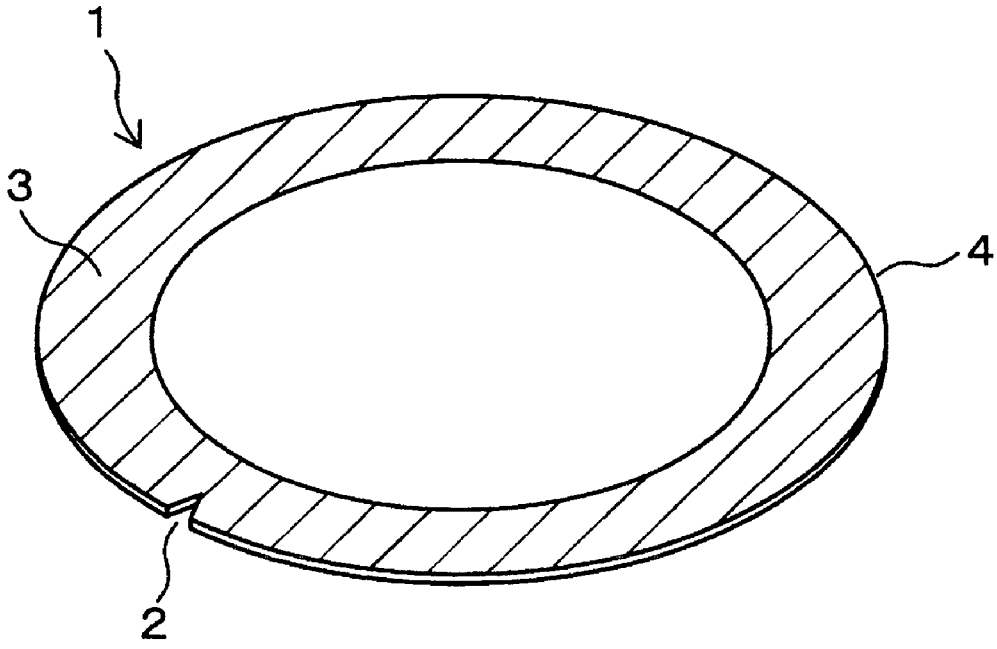
FIG. 1 is a perspective view of a semiconductor wafer on which only a peripheral portion (hatched area) is to be polished by a polishing method according to a preferred embodiment of the present invention.

A preferred embodiment of the present invention will now be described with reference to the drawings. Reference numeral 1 shown in FIG. 1 denotes a disk-shaped wafer. The wafer 1 is a semiconductor wafer such as a silicon wafer. A V-shaped notch 2 for indicating the crystal orientation of a semiconductor is formed on the outer circumference 4 of the wafer 1. In this preferred embodiment, only a peripheral portion (outer circumferential polishing area) 3 of the wafer 1 shown as a hatched area on the single side thereof is polished. The peripheral portion 3 to be polished is an annular area formed radially inside of the outer circumference 4 and having a predetermined width larger than the depth of the notch 2. The width of the peripheral portion 3 to be polished is determined, for example, according to the kind of the wafer 1. For example, the width of the peripheral portion 3 is set to about 2 mm or less than or equal to 2 mm. The peripheral portion 3 is polished by a polishing apparatus 10 shown in FIG. 2.

Figure 2:
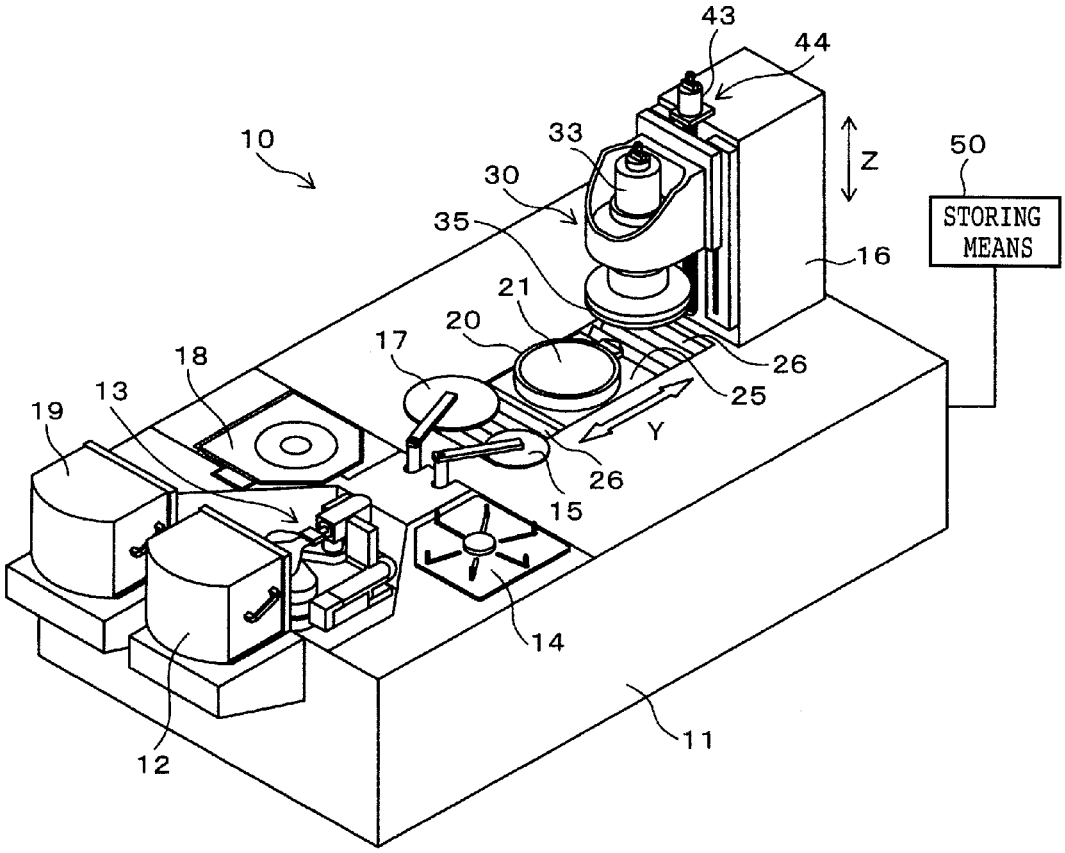
FIG. 2 is a perspective view of a polishing apparatus according to this preferred embodiment.

The configuration and operation of the polishing apparatus 10 will now be described. As shown in FIG. 2, the polishing apparatus 10 has a rectangular parallelepiped base 11. A supply cassette 12 is detachably set at a predetermined position on the base 11, and a plurality of wafers 1 are stored in the supply cassette 12. The plural wafers 1 are stacked in the supply cassette 12 in the condition where the single side of each wafer 1 having the peripheral portion 3 to be polished (the subject surface to be polished) is oriented upward. One of the plural wafers 1 is drawn out of the supply cassette 12 by a pickup robot 13. The wafer 1 thus drawn out of the supply cassette 12 is placed on a positioning table 14 in the condition where the subject surface of the wafer 1 is oriented upward. Thus, the wafer 1 is positioned on the positioning table 14.

The wafer 1 positioned on the positioning table 14 is lifted by a supply arm 15 and is next concentrically placed on a disk-shaped chuck table 20 in the condition where the subject surface of the wafer 1 is oriented upward. The chuck table 20 is of a vacuum chuck type well known in the art. The chuck table 20 has a horizontal upper surface on which the wafer 1 is to be placed. The upper surface of the chuck table 20 is concentrically formed with a circular vacuum suction surface 21 of a porous material or the like, and a narrow peripheral area is left around the vacuum suction surface 21. Before the wafer 1 is placed on the chuck table 20, the chuck table 20 is operated to produce a suction vacuum. Accordingly, the wafer 1 concentrically placed on the chuck table 20 is held on the vacuum suction surface 21 under the suction vacuum.

Figure 3:
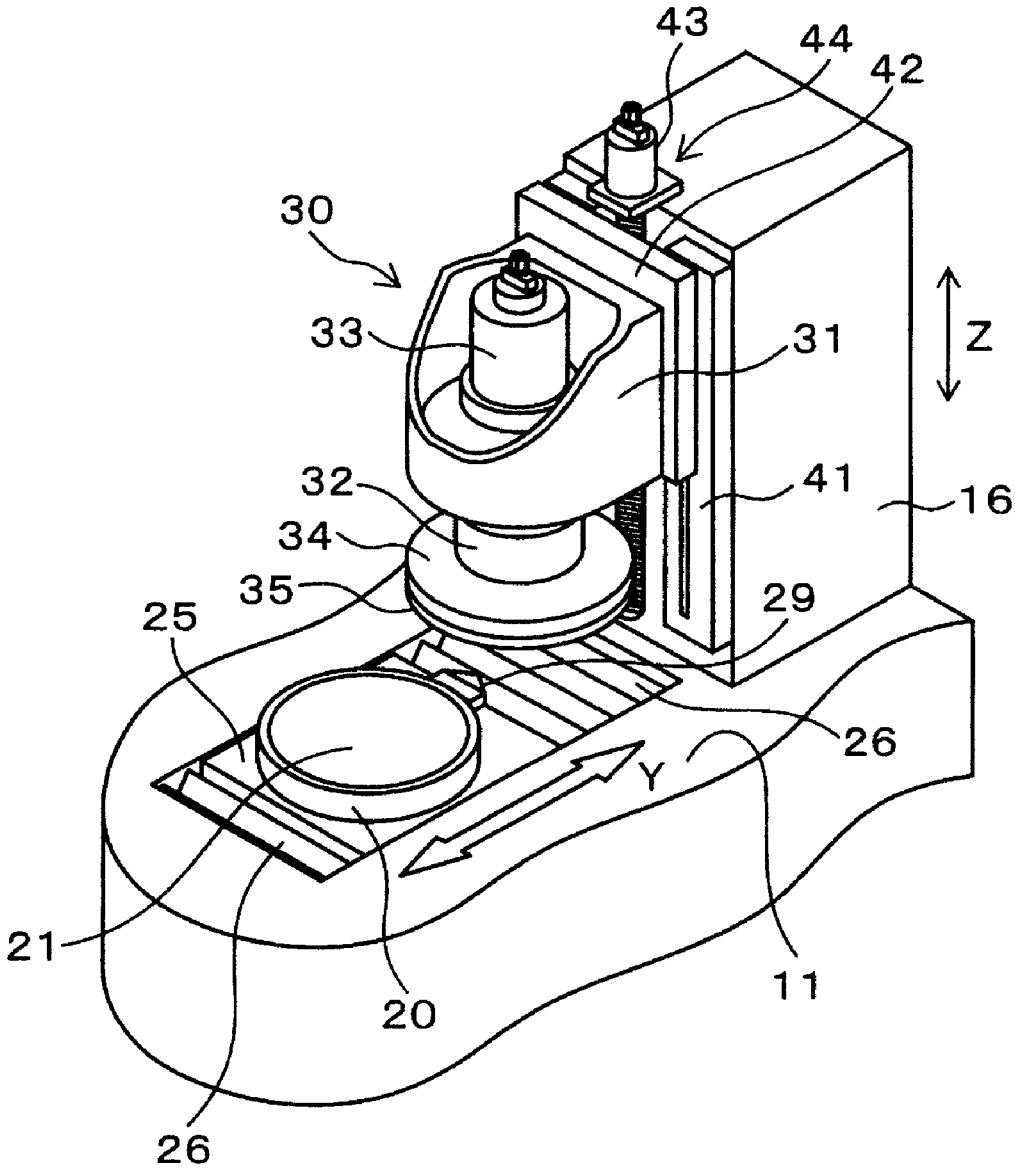
FIG. 3 is a perspective view showing a polishing unit and a chuck table in the polishing apparatus shown in FIG. 2.

As shown in FIG. 3, the chuck table 20 is supported on a table base 25. The table base 25 is provided on the base 11 so as to be horizontally movable in the direction shown by an arrow Y. The wafer 1 is fed through the table base 25 and the chuck table 20 from a mount/demount position where the wafer 1 is mounted/demounted to/from the chuck table 20 on the front side in the Y direction to a working position where the wafer 1 is polished on the rear side in the Y direction. A polishing unit 30 for polishing the peripheral portion 3 of the wafer 1 is provided above the working position. A bellows-like cover 26 for covering a moving path of the table base 25 to prevent the drop of chips or the like into the base 11 is provided on the base 11 so as to be expanded and contracted.

As shown in FIG. 3, a column 16 stands on the upper surface of the base 11 at its rear end portion in the Y direction, and the polishing unit 30 is mounted on the front surface of the column 16 so as to be movable in the direction shown by an arrow Z (vertical direction). A pair of right and left guides 41 are provided on the front surface of the column 16 so as to extend in the Z direction, and the polishing unit 30 is slidably mounted on the guides 41 through a slider 42. The polishing unit 30 is movable with the slider 42 in the Z direction by a ball screw type feeding mechanism 44 driven by a servo motor 43.

Figure 4:
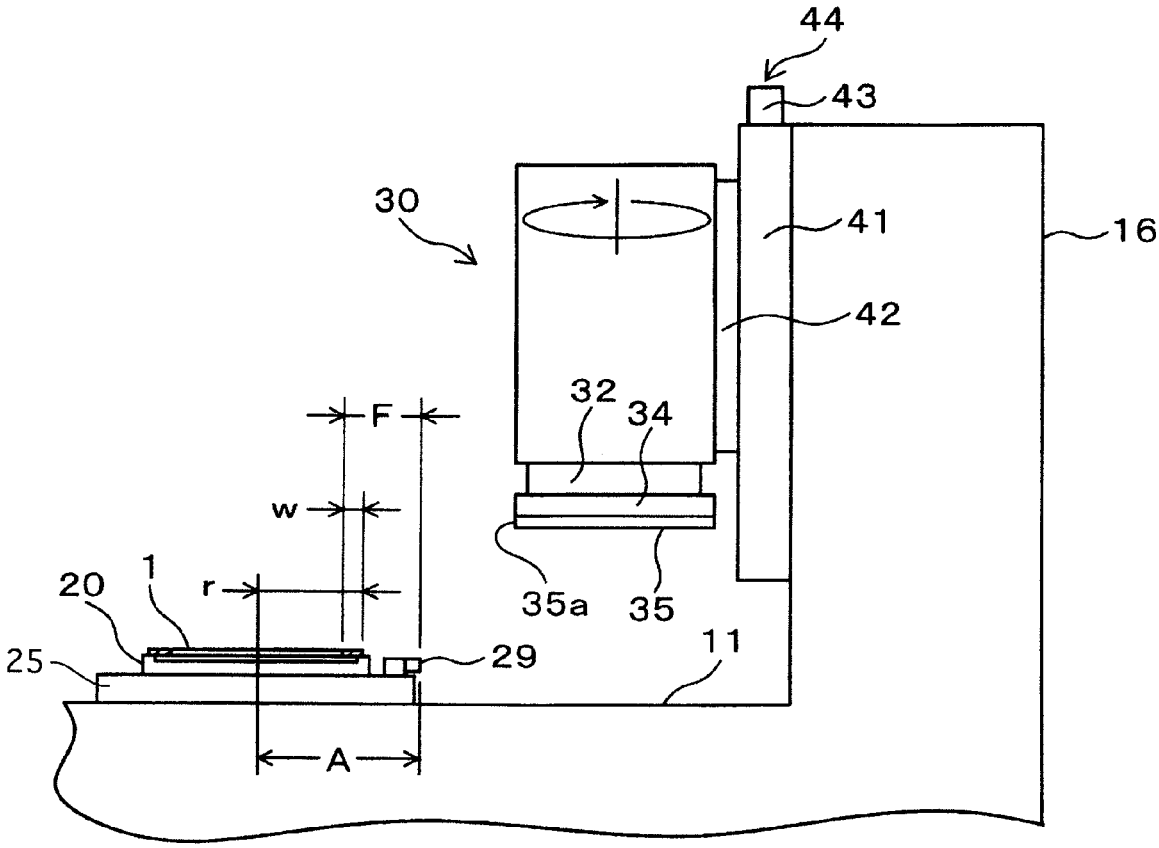
FIG. 4 is a side view of FIG. 3.

As shown in FIGS. 3 and 4, the polishing unit 30 includes a cylindrical spindle housing 31 having an axis extending in the Z direction and a spindle shaft 32 coaxially and rotatably supported in the spindle housing 31. The spindle shaft 32 is rotationally driven by a spindle motor 33 fixed to the upper end of the spindle housing 31. The spindle shaft 32 projects downward from the lower end of the spindle housing 31. A polishing member 35 is mounted through a disk-shaped flange 34 on the lower end of the spindle shaft 32.

The polishing member 35 is a disk-shaped formed member having a given thickness and the same diameter as that of the flange 34. The material of the polishing member 35 is selected according to the wafer 1 as an object to be polished. For example, the polishing member 35 is composed of a flexible base material such as polishing cloth, rubber, and elastomer and abrasive grains such as polycrystalline or monocrystalline silicon oxide, GC (green carborundum), and WA (white alundum) mixed and dispersed in the flexible base material. The size (diameter) of the disk-shaped polishing member 35 is arbitrary provided that the disk-shaped polishing member 35 can polish at least the peripheral portion 3 of the wafer 1. In this preferred embodiment, the disk-shaped polishing member 35 has such a diameter that it can polish the whole surface of the wafer 1 on the single side thereof. The lower surface of the polishing member 35 as a polishing surface is set horizontal, i.e., perpendicular to the axial direction of the spindle shaft 32. In other words, the polishing surface of the polishing member 35 is set parallel to the vacuum suction surface 21 of the chuck table 20.

The polishing apparatus 10 according to this preferred embodiment includes a cutting tool 29 for cutting the outer circumferential edge 35*a* of the polishing member 35 (which may be referred to as the outer circumferential surface of the polishing member 35 because it has a certain measure of thickness) to obtain a completely round shape. As shown in FIG. 4, the cutting tool 29 is fixed to the upper surface of the table base 25 at its rear end portion on the column 16 side. That is, the cutting tool 29 is located between the chuck table 20 and the polishing unit 30 in the horizontal Y direction so as to be movable together with the table base 25 in the Y direction.

As shown in FIG. 4, the tip of the cutting tool 29 for cutting the outer circumferential edge 35*a* of the polishing member 35 is pointed toward the column 16. The distance A between the tip of the cutting tool 29 and the center of rotation of the chuck table 20 (i.e., the center of the wafer 1 held on the chuck table 20) in the Y direction is fixed. This distance A is preliminarily stored in storing means 50 shown in FIG. 2. Further, the radius r of the wafer 1 held on the chuck table 20 and the width W of the peripheral portion 3 to be polished, which are prior known data, are also preliminarily stored in the storing means 50.

Figure 5A:
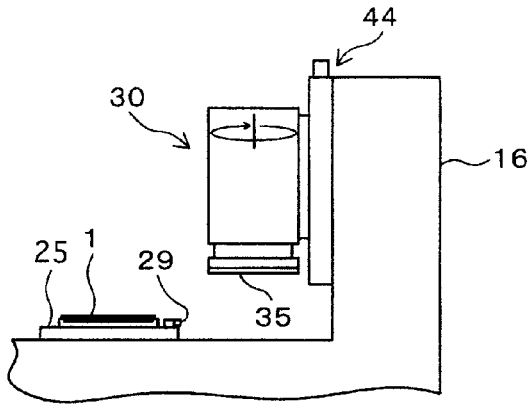
FIGS. 5A to 5E are side views showing the procedure of the polishing method according to this preferred embodiment.
Figure 5B:
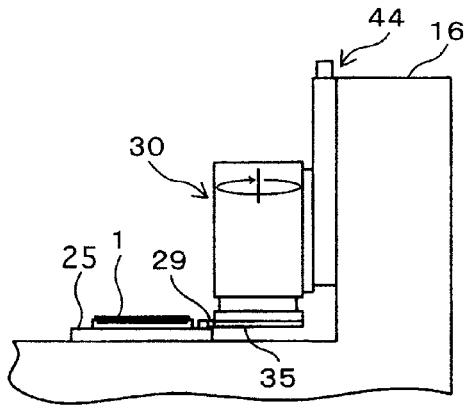

The procedure of polishing the peripheral portion 3 of the wafer 1 by using the polishing member 35 will now be described. FIG. 5A shows a condition before starting the polishing operation. In this condition, the polishing unit 30 is waiting at a position above the wafer 1, and the cutting tool 29 is waiting at a position before the polishing unit 30 (on the left side of the polishing unit 30 as viewed in FIG. 5A). From this initial condition, the polishing unit 30 is lowered (moved downward in the direction perpendicular to the vacuum suction surface 21) to make the height of the polishing member 35 equal to the height of the cutting tool 29, and the polishing member 35 is rotated. In the next step, the table base 25 is horizontally moved toward the column 16 as shown in FIG. 5B (rightward as viewed in FIG. 5B) to bring the cutting tool 29 into contact with the outer circumferential edge 35*a* of the polishing member 35 being rotated, thereby cutting the outer circumferential edge 35*a*. At this time, the movement of the table base 25 is stopped at a position where the whole of the outer circumferential edge 35*a* of the polishing member 35 can be cut by the cutting tool 29. After a predetermined time has elapsed, the whole of the outer circumferential edge 35*a* of the polishing member 35 is cut to make the outer circumferential edge 35*a* of the polishing member 35 completely round (completely round polishing member forming step).

At the time the polishing member 35 is formed into a completely round shape as mentioned above, the reference position of the wafer 1 held on the chuck table 20 relative to the polishing unit 30 in the Y direction is determined. In a subsequent step to be described later, the table base 25 is horizontally moved toward the column 16 from the above reference position to a position where only the peripheral portion 3 of the wafer 1 is polished by the polishing member 35. The travel of the table base 25 in this step is equal to the distance F from the tip of the cutting tool 29 to the inner circumference of the peripheral portion 3 as shown in FIG. 4. This distance (the horizontal travel of the table base 25 from the reference position) F can be obtained from the distance A from the tip of the cutting tool 29 to the center of rotation of the chuck table 20 on which the wafer 1 is concentrically held, the radius r of the wafer 1, and the width W of the peripheral portion 3. That is, the distance F is calculated by the expression of "(the distance A−the radius r of the wafer 1)+the width W of the peripheral portion 3." This horizontal travel F of the table base 25 is also preliminarily stored in the storing means 50.

Figure 5C:
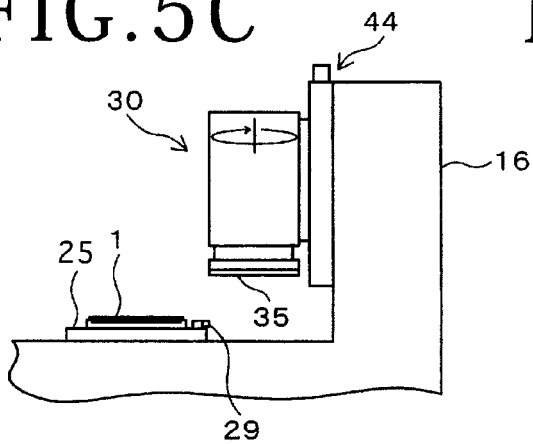
Figure 5D:
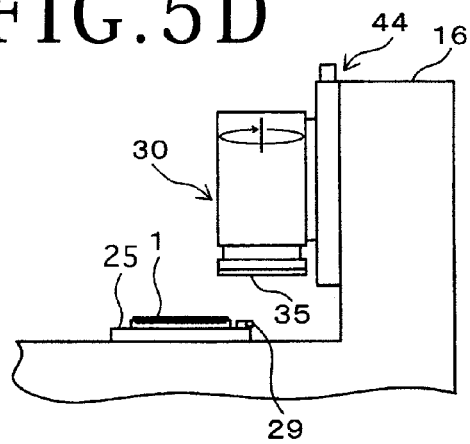

After forming the polishing member 35 into a completely round shape, the polishing unit 30 is once lifted (moved upward in the direction perpendicular to the vacuum suction surface 21) in the condition where the table base 25 is kept still at the reference position as shown in FIG. 5C. Thereafter, the table base 25 is horizontally moved from the reference position toward the column 16 by the above-mentioned horizontal distance F as shown in FIG. 5D (working means positioning step). Accordingly, the position of the polishing member 35 relative to the wafer 1 in the Y direction is set so that only the peripheral portion 3 of the wafer 1 can be polished by the polishing member 35. In this working position, the outer circumferential edge 35*a* of the polishing member 35 coincides with the inner circumference of the peripheral portion 3 to be polished in the Z direction.

Figure 5E:
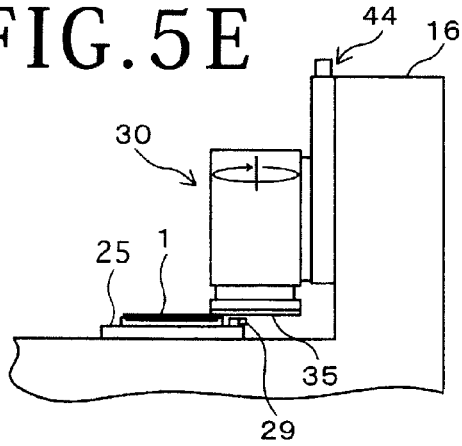

Thereafter, the polishing unit 30 is lowered to bring the polishing member 35 into pressure contact with the wafer 1 under a predetermined load as shown in FIG. 5E. In the previous step, the position of the polishing unit 30 relative to the wafer 1 in the Y direction is set so that only the peripheral portion 3 of the wafer 1 is to be polished by the polishing member 35. Therefore, only the peripheral portion 3 of the wafer 1 is polished by a peripheral portion of the lower surface of the polishing member 35 (polishing step).

After a predetermined polishing time has elapsed to complete the polishing of the peripheral portion 3, the polishing unit 30 is lifted to the standby position shown in FIG. 5A. Further, the table base 25 is returned to the above-mentioned mount/demount position. At this mount/demount position, the suction holding operation of the chuck table 20 is stopped to demount the wafer 1 from the chuck table 20. Thereafter, the wafer 1 is transferred from the chuck table 20 to a spinner type cleaning unit 18 by a recovery arm 17. In the spinner type cleaning unit 18, the wafer 1 is cleaned and dried. Thereafter, the wafer 1 is taken into a recovery cassette 19 by the pickup robot 13.

After the above procedure for the single wafer 1 is finished, the other many wafers 1 stored in the supply cassette 12 are sequentially polished in the same manner as that mentioned above. It is sufficient that the setting of the reference position of the table base 25 is to be made only once in polishing the first wafer 1, and the polishing is performed repeatedly for the other wafers 1 without changing the reference position. However, in the case that the processing conditions including the size of the wafer 1 to be polished and the width of the peripheral portion 3 are varied, the resetting of the reference position is performed according to the new processing conditions.

According to the polishing method for the peripheral portion 3 in the above preferred embodiment, the table base 25 is horizontally moved toward the column 16 to form the outer circumferential edge 35*a* of the polishing member 35 into a completely round shape by using the cutting tool 29 and to simultaneously set the reference position of the table base 25 in the Y direction. Thereafter, the table base 25 is moved from this reference position toward the column 16 by the distance F obtained from the positional relation between the cutting tool 29 and the chuck table 20, thereby making the Y-directional position of the polishing member 35 into correspondence with the Y-directional position of the peripheral portion 3 of the wafer 1 to be polished. Accordingly, only the peripheral portion 3 of the wafer 1 can be polished accurately and easily. Further, high reproducibility can be obtained in processing many wafers 1. In particular, the polishing method capable of accurately polishing only the peripheral portion 3 in the above preferred embodiment is effective in the case that the width of the peripheral portion 3 is as relatively small as 2 mm or less.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A wafer polishing method for polishing an annular outer circumferential polishing area set on one surface of a disk-shaped wafer with a predetermined width from the outer circumferential edge of said wafer by using a polishing apparatus including:

holding means having a holding surface for rotatably holding said wafer;

working means having a disk-shaped polishing member opposed to said holding surface and rotatably supporting said polishing member so that said polishing member is rotatable about a rotation axis substantially perpendicular to said holding surface;

first feeding means for relatively moving said working means to said holding means in a first direction substantially parallel to said holding surface;

second feeding means for relatively moving said working means to said holding means in a second direction substantially perpendicular to said holding surface; and completely round polishing member forming means for forming the outer circumferential edge of said polishing member into a completely round shape about said rotation axis;

said wafer polishing method comprising:

a completely round polishing member forming step of forming the outer circumferential edge of said polishing member into a completely round shape about said rotation axis by using said completely round polishing member forming means;

a working means positioning step of relatively moving said working means parallel to said holding means in said first direction by using said first feeding means after said completely round polishing member forming step according to a distance in said first direction between the outer circumferential edge of said wafer held by said holding means and said completely round polishing member forming means, thereby positioning said working means in said first direction so that only said outer circumferential polishing area can be polished by said polishing member; and a polishing step of moving said working means in said second direction toward said holding means by using said second feeding means after said working means positioning step, thereby bringing said polishing member into pressure contact with said outer circumferential polishing area of said wafer to polish only said outer circumferential polishing area.

2. The wafer polishing method according to claim 1, wherein:

said completely round polishing member forming step comprises the step of making the outer circumferential edge of said polishing member into contact with said completely round polishing member forming means as rotating said polishing member; and said completely round polishing member forming means is provided between said holding means and said working means in said first direction, and is movable together with said holding means in said first direction.

3. The wafer polishing method according to claim 1, wherein the width of said outer circumferential polishing area is less than or equal to 2 mm.

4. A wafer polishing apparatus for polishing an annular outer circumferential polishing area set on one surface of a disk-shaped wafer with a predetermined width from the outer circumferential edge of said wafer, said wafer polishing apparatus comprising:

holding means having a holding surface for rotatably holding said wafer;

working means having a disk-shaped polishing member opposed to said holding surface and rotatably supporting said polishing member so that said polishing member is rotatable about a rotation axis substantially perpendicular to said holding surface;

first feeding means for relatively moving said working means to said holding means in a first direction substantially parallel to said holding surface;

second feeding means for relatively moving said working means to said holding means in a second direction substantially perpendicular to said holding surface;

completely round polishing member forming means for forming the outer circumferential edge of said polishing member into a completely round shape about said rotation axis; and storing means for storing a distance in said first direction between the outer circumferential edge of said wafer held by said holding means and said completely round polishing member forming means.

5. The wafer polishing apparatus according to claim 4, wherein:

said completely round polishing member forming means is provided between said holding means and said working means in said first direction, and is movable together with said holding means in said first direction; and the outer circumferential edge of said polishing member is made into contact with said completely round polishing member forming means as rotating said polishing member, so that the outer circumferential edge of said polishing member is formed into a completely round shape about said rotation axis.

6. The wafer polishing apparatus according to claim 4, wherein the width of said outer circumferential polishing area is less than or equal to 2 mm.

* * * * *